US008339387B2

(12) United States Patent
Murase et al.

(10) Patent No.: US 8,339,387 B2
(45) Date of Patent: Dec. 25, 2012

(54) DISPLAY DEVICE AND ELECTRONIC APPARATUS

(75) Inventors: Masaki Murase, Kanagawa (JP); Daisuke Ito, Tokyo (JP); Masaaki Tonogai, Tokyo (JP); Yoshitoshi Kida, Kanagawa (JP); Yoshiharu Nakajima, Kanagawa (JP)

(73) Assignee: Sony Corporation, Tokyo (JP)

( * ) Notice: Subject to any disclaimer, the term of this patent is extended or adjusted under 35 U.S.C. 154(b) by 1026 days.

(21) Appl. No.: 11/886,658

(22) PCT Filed: Jan. 19, 2007

(86) PCT No.: PCT/JP2007/050791

§ 371 (c)(1),
(2), (4) Date: Jan. 5, 2009

(87) PCT Pub. No.: WO2007/083743

PCT Pub. Date: Jul. 26, 2007

(65) Prior Publication Data

US 2009/0213101 A1 Aug. 27, 2009

(30) Foreign Application Priority Data

Jan. 20, 2006 (JP) ..... 2006-013126

(51) Int. Cl.
*G09G 5/00* (2006.01)

(52) U.S. Cl. ..... 345/211; 327/333

(58) Field of Classification Search ..... 345/50–100; 326/61–92

See application file for complete search history.

(56) References Cited

U.S. PATENT DOCUMENTS 5,861,863 A * 1/1999 Kudo et al. ..... 345/100
5,990,857 A 11/1999 Kubota et al.
2001/0033254 A1 * 10/2001 Furusato et al. ..... 345/55
2001/0035862 A1 11/2001 Nakamura et al.
2002/0075249 A1 6/2002 Kubota et al.
2004/0174197 A1 9/2004 Kida et al.
2004/0174334 A1 * 9/2004 Washio et al. ..... 345/102
2004/0202276 A1 10/2004 Osame et al.

FOREIGN PATENT DOCUMENTS

JP 2002-175033 6/2002
JP 2002-196732 7/2002
WO WO-2004/057760 7/2004

OTHER PUBLICATIONS

Extended European Search Report issued Jan. 23, 2012 for corresponding Application No. 07 70 7079.

* cited by examiner

*Primary Examiner* — Amare Mengistu
*Assistant Examiner* — Vinh Lam
(74) *Attorney, Agent, or Firm* — Rader Fishman & Grauer, PLLC

(57) ABSTRACT

A display device able to amplify the same input as a power supply voltage of IC by using low temperature polysilicon having high threshold voltage and large variation and an electronic apparatus using the same, including MCK use level shifters 171-1 and 171-2 of a type where a reset operation is periodically necessary, a logic circuit 173 for using a level shift horizontal synchronization signal Hsync to input reset pulses for the MCK level shifters 171-1 and 171-2 having a period of N horizontal periods shifted in phase by M horizontal periods (note, M<N) to the level shifters 171-1 and 171-2 and outputting the resultant signals, and a function of selecting the circuit not performing the reset operation among outputs of the L number of level shifters 171-1 and 171-2 for each M horizontal periods and outputting a level shift master clock LSMCK as a last output signal.

8 Claims, 16 Drawing Sheets

IMPROVE CHARACTERISTICS OF INVERTER OF AMPLIFICATION STAGE IN ORDER TO RAISE DYNAMIC RANGE OF LEVEL CONVERSION CIRCUIT

DISPLAY DEVICE AND ELECTRONIC APPARATUS

TECHNICAL FIELD

The present invention relates to an active matrix type display device such as a liquid crystal display device and an electronic apparatus using the same.

BACKGROUND ART

In recent years, mobile phones and PDAs (digital personal assistants) and other mobile terminals have been spreading remarkably. One reason of the factors behind the rapid spread of these mobile terminals is the mount of the liquid crystal display devices thereon as output display parts. This is because liquid crystal display devices are display devices having the feature of basically not requiring power for driving and consuming low power.

In active matrix type display devices using polysilicon TFTs (thin film transistors) as switching elements for pixels, the trend is to integrally form a digital interface drive circuit with a display area where pixels are arranged in a matrix, on the same substrate.

In this integral drive circuit type display device, a horizontal drive system and a vertical drive system are arranged at a periphery (frame) in an effective display portion, these drive systems are integrally formed with the pixel area on the same substrate, using low temperature polysilicon TFTs.

FIG. 1 is a diagram showing the schematic configuration of a general integral drive circuit type display device (refer, for example, Patent Document 1).

In this liquid crystal display device, as shown in FIG. 1, an effective display portion 2 in which a plurality of pixels including liquid crystal cells are arranged in the matrix on a transparent insulating substrate, for example, a glass substrate 1, on which, a pair of horizontal drive circuits (H drivers) 3U and 3D arranged above and below the effective display portion 2 in FIG. 1, a vertical drive circuit (V driver) 4 arranged at a side of the effective display portion 2 in FIG. 1, one reference voltage generation circuit (REF DRV) 5 generating a plurality of reference voltages, a data processing circuit (DATAPRC) 6, etc. are integrated.

In this way, in the integral drive circuit type display device in FIG. 1, two horizontal drive circuits 3U and 3D are arranged on the two sides (above and below in FIG. 1) of the effective pixel portion 2, since data lines are separated into odd number lines and even number lines, and both lines are separately driven.

FIG. 2 is a block diagram showing an example of the configuration of the horizontal drive circuits 3U and 3D in FIG. 1 for separately driving odd number lines and even number lines.

As shown in FIG. 2, the horizontal drive circuit 3U for driving odd number lines and the horizontal drive circuit 3D for driving even number lines have the same configuration.

Specifically, they have shift register (HSR) groups 3HSRU and 3HSRD consecutively outputting shift pulses (sampling pulses) in synchronization with horizontal transfer clocks HCK (not shown), sampling latch circuit groups 3SMPLU and 3SMPLD consecutively sampling and latching digital image data by sampling pulses given from shift registers 31U and 31D, linear consecutive latch circuit groups 3LTCU and 3LTCD for linearly consecutive latch data of sampling latch circuits 32U and 32D, and digital/analog conversion circuit (DAC) groups 3DACU and 3DACD converting digital image data linearly sequenced at linearly sequencing latch circuits 33U and 33D to analog image signals Note that usually level shift circuits are arranged at the input stages of the DACs 34U and 34D, and the data after being raised in level are input to the DAC 34.

Patent Document 1: Japanese Patent Publication (A) No. 2002-175033

DISCLOSURE OF THE INVENTION

Problem to be Solved by the Invention

The liquid crystal display device in FIG. 1 etc. is configured so as to shift the level of for example the master clock MCK having a predetermined level or the horizontal synchronization signal Hsync from the outside to in-panel logic levels by a level shift circuit in an RGB interface circuit and supply the result to a desired circuit formed on the insulating substrate.

In general, in a level shift circuit is configured to arrange a CMOS inverter supplied with low power supply voltages (panel input voltage, set output voltage) at its input stage and to shift the level by the level shift stages at the next and subsequent stages to which high power supply voltages (in-panel logic drive voltages) are supplied, and accordingly it suffers from the following disadvantages.

In the current low temperature polysilicon TFTs, the threshold voltage $V_{th}$ rises up to about 1.5V at the time of re-rising.

Accordingly, in the level shifter circuit of the type described above, when the input power supply voltage drops to for example about 1.8V, the gate voltage ends up falling to near the threshold voltage $V_{th}$ of a transistors Tr forming an inverter, as a result it becomes difficult to operate the circuit for high frequency signals.

For this reason, when commercializing integral drive circuit type display panels, if the signal amplitude output from the set side is low, a level conversion chip externally installed between the set and the panel becomes necessary, therefore this becomes big disadvantageous in view of cost, reliability, and appearance.

The present invention is to provide a display device having a high threshold voltage and able to amplify an input voltage the same as the power supply voltage of an IC by using low temperature polysilicon having large variation, and an electronic apparatus using the same.

Means for Solving the Problem

A first aspect of the present invention is an integral drive circuit type display device supplied with at least a master clock, having a level conversion circuit for converting a first level at the time of input of the master clock to a second level of an internal drive voltage level and outputting the same to a predetermined circuit, wherein the level conversion circuit includes L number of level shifters of a type where a reset operation is necessary periodically, a logic circuit for inputting reset pulses for the MCK level shifters having a period of N horizontal periods shifted by M horizontal periods (where $\overline{M}<N$) to the level shifters based on a level shifted horizontal synchronization signal Hsync and outputting the resultant signals, and a function of selecting a circuit not performing the reset operation among the outputs of the L number of level shifters for the M horizontal periods and outputting the level shifted master clock as a last output signal.

Preferably, the level shifter includes an inverter connected between the internal drive voltage level potential and a reference potential, a first node, a second node connected to the input of the inverter, a third node connected to the output of the inverter, a capacitor connected between the first node and the second node, and a circuit for preventing the input of the master clock for exactly a reset period, supplying the reference voltage as an intermediate potential of the first level potential and reference potential to the first node, and bringing the second node and the third node into conductive states.

Preferably, the second node and the third node are connected by a switching transistor, and the gate potential of the switching transistor is held at a negative potential when not conductive.

Preferably, the inverter is connected to the negative potential in place of the reference potential.

A second aspect of the present invention is an electronic apparatus having an integral drive circuit type display device supplied with at least a master clock, wherein the display device has a level conversion circuit for converting a first level at the time of input of the master clock to a second level of an internal drive voltage level and outputting the same to a predetermined circuit, and wherein the level conversion circuit includes L number of level shifters of a type where a reset operation is necessary periodically, a logic circuit for inputting reset pulses for the MCK level shifters having a period of N horizontal periods shifted by M horizontal periods (where M<N) to the level shifters based on a level shifted horizontal synchronization signal Hsync and outputting the resultant signals, and a function of selecting a circuit not performing the reset operation among the outputs of the L number of level shifters for the M horizontal periods and outputting the level shifted master clock as a last output signal.

Effect of the Invention

According to the present invention, it becomes possible to eliminate the cost of the externally installed ICs and decrease the number of externally installed parts.

Further, since the externally installed part become unnecessary, it becomes possible to contribute to the reduction of thickness of a module.

DESCRIPTION OF NOTATIONS

10 . . . liquid crystal display device, 11 . . . glass substrate, 12 . . . effective display portion, 13 . . . horizontal drive circuit, 13U . . . first horizontal drive circuit, 13D . . . second horizontal drive circuit, 13SMPL . . . sampling latch circuit group, 131 . . . first sampling latch circuit, 132 . . . second sampling latch circuit, 133 . . . third sampling latch circuit, 134 . . . first latch circuit, 134 . . . first latch circuit, 135 . . . second latch circuit, 136 . . . third latch circuit, 137 . . . first latch system, 138 . . . second latch system, 13OSEL . . . latch output selection switch, 13DAC . . . digital/analog conversion circuit, 13ABUD . . . analog buffer, 13LSEL . . . line selector, 14 . . . vertical drive circuit, 15 . . . data processing circuit, 16 . . . power supply circuit, 17 . . . interface circuit, 17LSMCK . . . level conversion circuit, 171-1, 171-2 . . . MCK use level shifters, 172 . . . asynchronous type level shift circuit, 173 . . . logic circuit, 174 . . . reference voltage generation circuit, 175, 176 . . . switch circuits, 177 . . . inverter, and 177, 18 . . . timing generators.

BEST MODE FOR CARRYING OUT THE INVENTION

Below, a detailed explanation will be given of embodiments of the present invention with reference the drawings.

Figure 3:
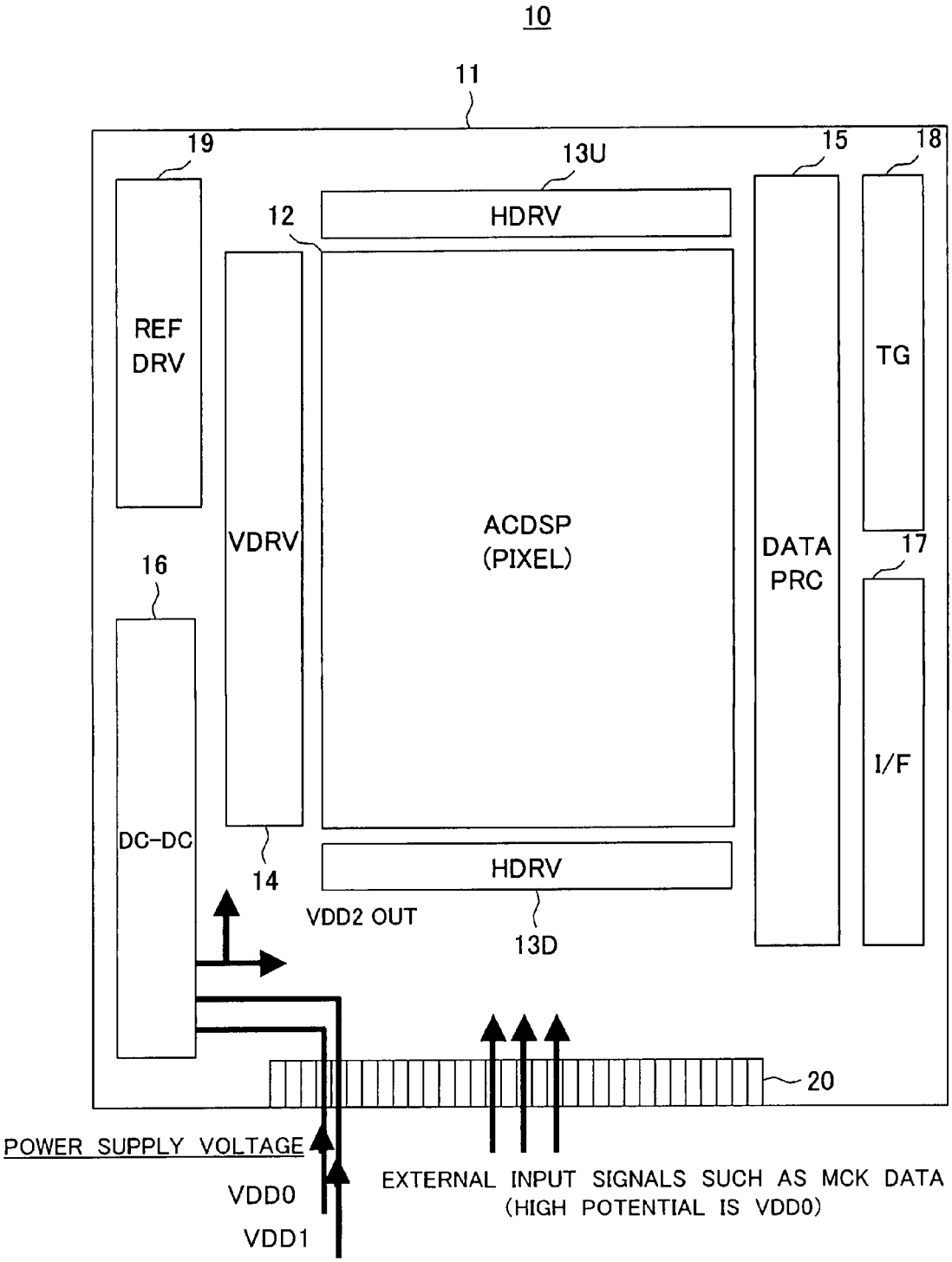
FIG. 3 is a view showing the layout of the integral drive circuit type display device according to an embodiment of the present invention.
Figure 4:
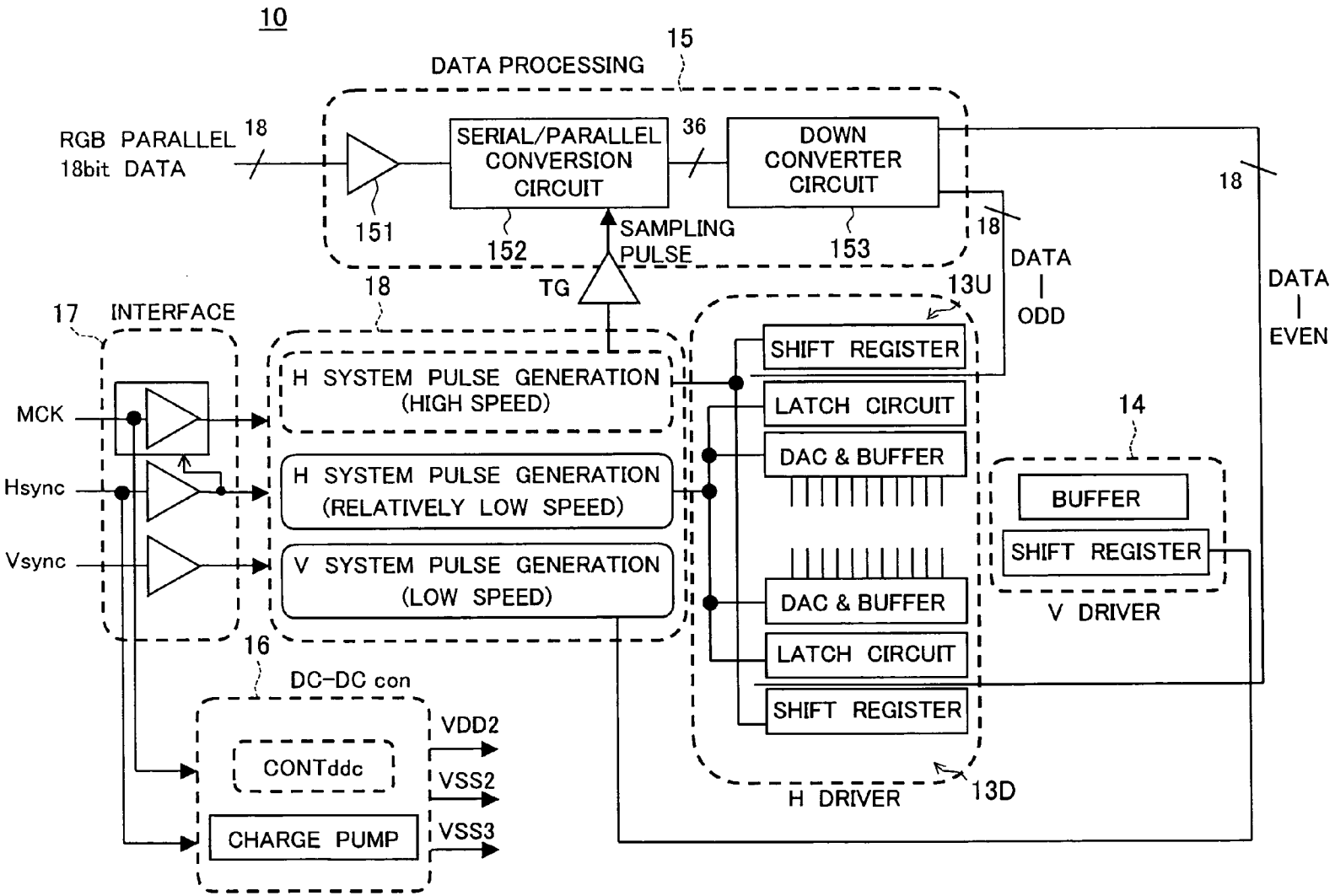
FIG. 4 is a system block diagram showing the circuit function of the integral drive circuit type display device according to the embodiment of the present invention.

FIG. 3 and FIG. 4 are schematic configuration views showing an example of the configuration of an integral drive circuit type display device according to an embodiment of the present invention, in which FIG. 3 is a view showing a layout of the integral drive circuit type display device according to the present embodiment, and FIG. 4 is a system block diagram showing circuit functions of the integral drive circuit type display device according to the present embodiment.

Here, an explanation will be given by taking as an example a case where the present invention is applied to an active matrix type liquid crystal display device using liquid crystal cells as electro-optical elements of pixels.

Figure 1:
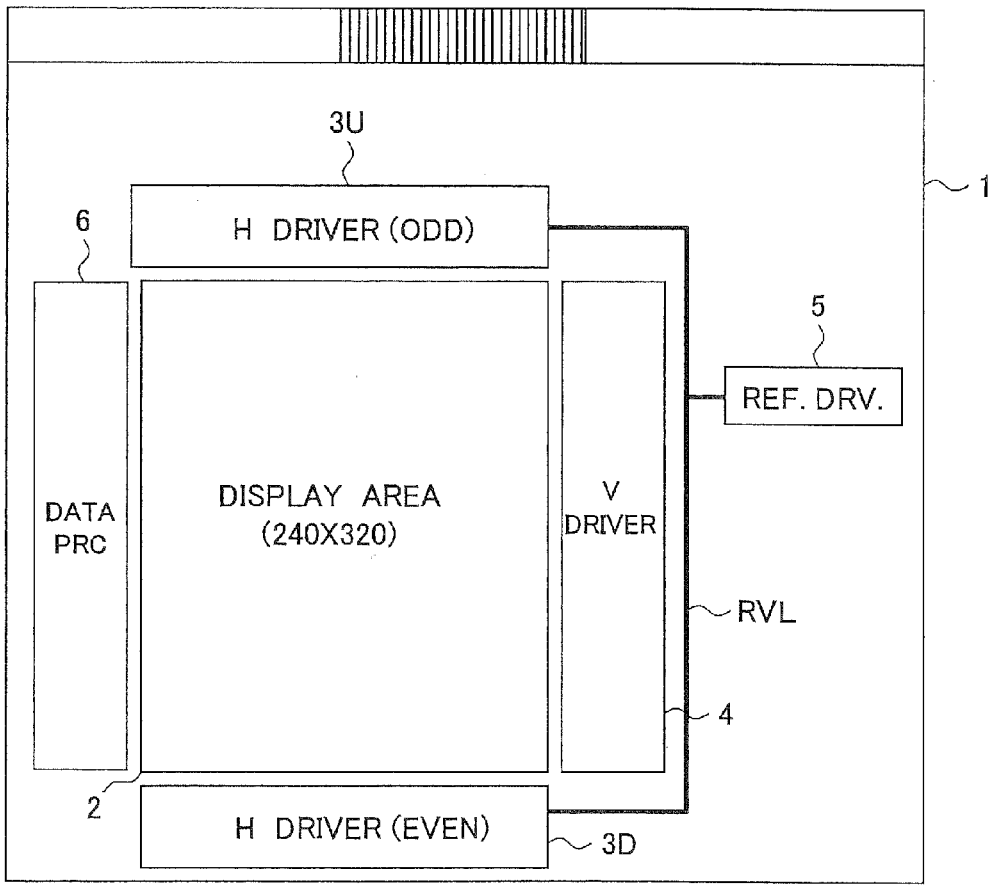
FIG. 1 RELATED ART
FIG. 1 is a view showing the schematic configuration of a general integral drive circuit type display device.
Figure 2:
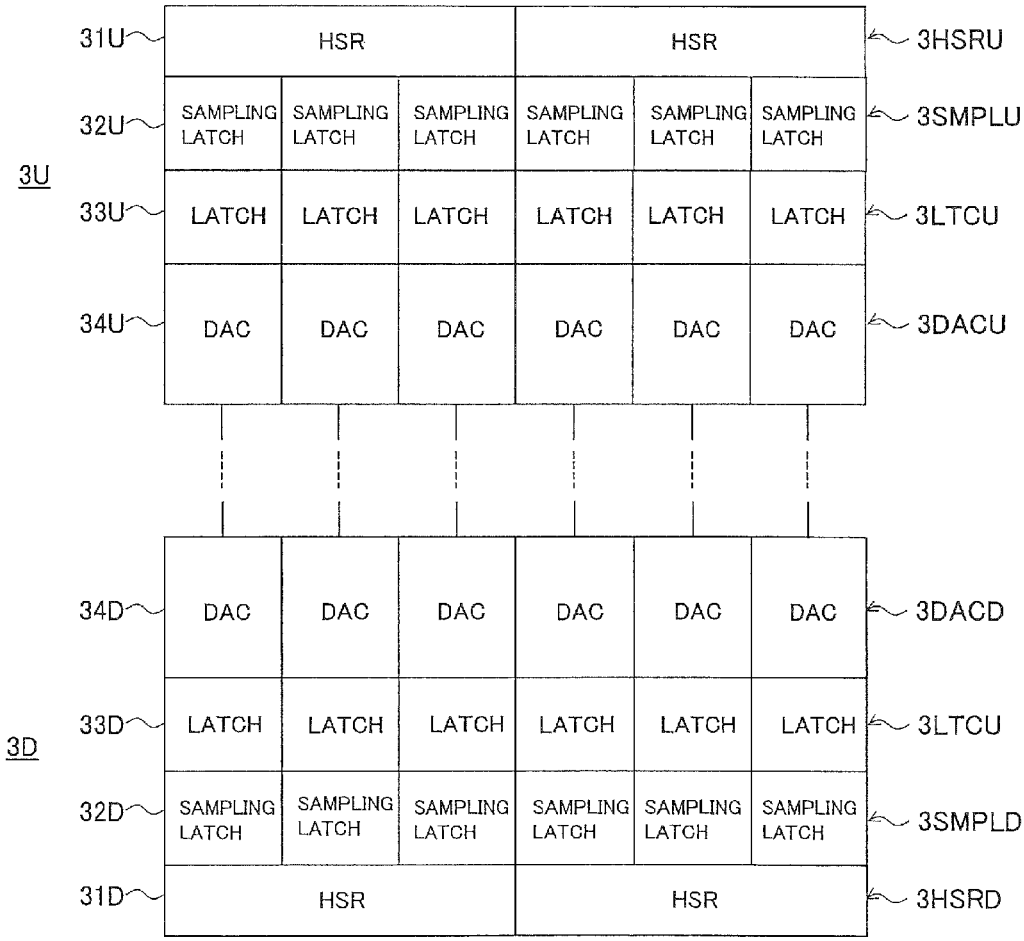
FIG. 2 RELATED ART
FIG. 2 is a block diagram showing an example of the configuration of a horizontal drive circuit in FIG. 1 separately driving odd number lines and even number lines.

In this liquid crystal display device 10, as shown in FIG. 3, an effective display portion (ACDSP) 12 in which a plurality of pixels including liquid crystal cells are arranged in a matrix on a transparent insulating substrate such as a glass substrate 11, a pair of first and second horizontal drive circuits (H drivers, HDRV) 13U and 13D arranged above and below the effective display portion 12 in FIG. 3, a vertical drive circuit (V driver, VDRV) 14 arranged at a side of the effective display portion 2 in FIG. 1, a data processing circuit (DATAPRC) 15, a power supply circuit (DC-DC) 16 formed by a DC-DC converter, an interface circuit (I/F) 17, a timing generator (TG) 18, and a reference voltage drive circuit (REFDRV) 19 for supplying a plurality of drive reference voltages to the horizontal drive circuits 13U and 13D, and so on, are integrated.

Further, a pad 20 for inputting data etc. is formed at an edge portion in the vicinity of the position of the second horizontal drive circuit 13D on the glass substrate 11.

The glass substrate 11 is constituted by a first substrate in which a plurality of pixel circuits including active elements (for example transistors) are arranged in a matrix, and a second substrate arranged facing this first substrate at a predetermined gap. Liquid crystal is sealed between these first and second substrates.

The circuit group formed on the insulating substrate is formed by the low temperature polysilicon TFT process. Namely, this integral drive circuit type display device 10 is configured by a horizontal drive system and a vertical drive system arranged at the periphery (frame) of the effective display portion 12, and these drive systems are integrally formed on the same substrate together with the pixel area portion by using polysilicon TFTs.

In the integral drive circuit type liquid crystal display device 10 of the present embodiment two horizontal drive circuits 13U and 13D are arranged on the two sides (above and below in FIG. 3) of the effective pixel portion 12, the reason why is for driving data lines separated into odd number lines and even number lines.

In the two horizontal drive circuits 13U and 13D an RGB selector system is employed by storing three digital data in sampling latch circuits, performing conversion processing to analog data three times by a common digital/analog conversion circuit during one horizontal period (H), selecting three analog data in the horizontal period in a time division manner, and outputting the same to data lines (signal lines).

In the present embodiment, an explanation will be given for defining that, among the three digital image data R, G, and B, the digital R data is as the first digital data, the digital B data is as the second digital data, and the digital G data as the third digital data.

Below, configurations and functions of the components of the liquid crystal display device 10 of the present embodiment will be sequentially explained.

The effective display portion 12 has a plurality of pixels including liquid crystal cells, and arranged in a matrix.

Further, in the effective display portion 12, data lines and vertical scanning lines which are driven by the horizontal drive circuits 13U and 13D and the vertical drive circuit 14 are arranged in a matrix.

Figure 5:
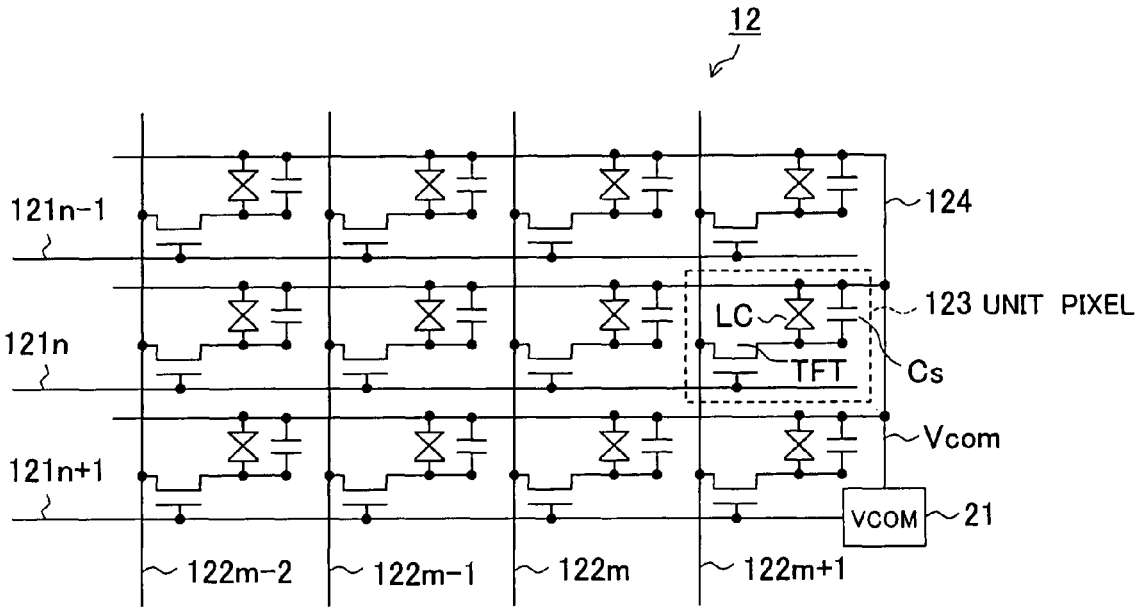
FIG. 5 is a circuit diagram showing an example of the configuration of an effective display portion of a liquid crystal display device.

FIG. 5 is a view showing an example of the concrete configuration of the effective display portion 12.

Here, for simplification of the drawing, a case of a pixel array of three rows (n−1-th row to n+1-th row) and four columns (m−2-th column to m+1-th column) is employed as an example.

FIG. 5, in the display portion 12, vertical scanning lines . . . , 121$n$−1, 121$n$, 121$n$+1, . . . , and data lines . . . , 122$m$−2, 122$m$−1, 122$m$, 122 $m$+1, . . . are arranged in a matrix, and unit pixels 123 are arranged at their intersecting points.

The unit pixel 123 is configured to have a thin film transistor TFT as the pixel transistor, a liquid crystal cell LC, and a storage capacitance Cs. Here, the liquid crystal cell LC means the capacitance generated between a pixel electrode (one electrode) formed by the thin film transistor TFT and a counter electrode (other electrode) formed facing the pixel electrode.

Gate electrodes of the thin film transistors TFT are connected to the vertical scanning lines . . . , 121$n$−1, 121$n$, 121$n$+1, . . . and source electrodes thereof are connected to data lines . . . , 122$m$−2, 122$m$−1, 122$m$, 122$m$+1, . . . .

For the liquid crystal cell LC, its pixel electrode is connected to a drain electrode of the thin film transistor TFT and its counter electrode is connected to a common line 124. The storage capacitance Cs is connected between the drain electrode of the thin film transistor TFT and the common line 124.

To the common line 124, a predetermined AC voltage is given as a common voltage Vcom by a VCOM circuit 21 integrally formed with the drive circuit etc. on the glass substrate 11.

Each end of the vertical scanning lines . . . , 121$n$−1, 121$n$, 121$n$+1, . . . is connected to each output end of the corresponding rows of the vertical drive circuit 14 shown in FIG. 3.

The vertical drive circuit 14 is configured to include for example a shift register, consecutively generates vertical selection pulses in synchronization with vertical transfer clocks VCK (not shown), and gives the same to the vertical scanning lines . . . , 121$n$−1, 121$n$, 121$n$+1, . . . to thereby to perform the vertical scanning.

Further, in the display portion 12, for example, each end of the data lines . . . 122$m$−2, 122$m$−1, 122$m$, 122$m$+1, . . . is connected to each output end of the corresponding columns of the first horizontal drive circuit 13U shown in FIG. 3, while their other ends are connected to the output ends of the corresponding columns of the second horizontal drive circuit 13D shown in FIG. 3.

The first horizontal drive circuit 13U stores three digital data of R data, B data, and G data in the sampling latch circuits, performs the conversion processing to analog data three times during one horizontal period (H), selects three data in the horizontal period in a time division manner, and outputs the same to corresponding data lines.

The first horizontal drive circuit 13U transfers, along with employment of this RGB selector system, the R data and B data latched at the first and second sampling latch circuits to the first latch circuit and further the second latch circuit in a time division manner, transfers the G data latched in the third sampling latch circuit to the third latch circuit in the period of the time division like transfer of these R data and B data to the latch circuits, selectively outputs the R, B, or G data latched in the second latch circuit and third latch circuit during one horizontal period to convert the same to the analog data, selects three analog data in the horizontal period in a time division manner, and outputs the same to the corresponding data lines.

Namely, in the horizontal drive circuit 13U of the present embodiment, in order to realize the RGB selector system, it is configured to arrange in parallel a first latch system for two digital R and B data and a second latch system for one digital G data and to share a digital/analog conversion circuit (DAC), an analog buffer, and a line selector, subsequent to the selector, are to thereby achieve narrowing of the frame and lowering of the power consumption.

The second horizontal drive circuit 13D basically has the same configuration as that of the first horizontal drive circuit 13U.

Figure 6:
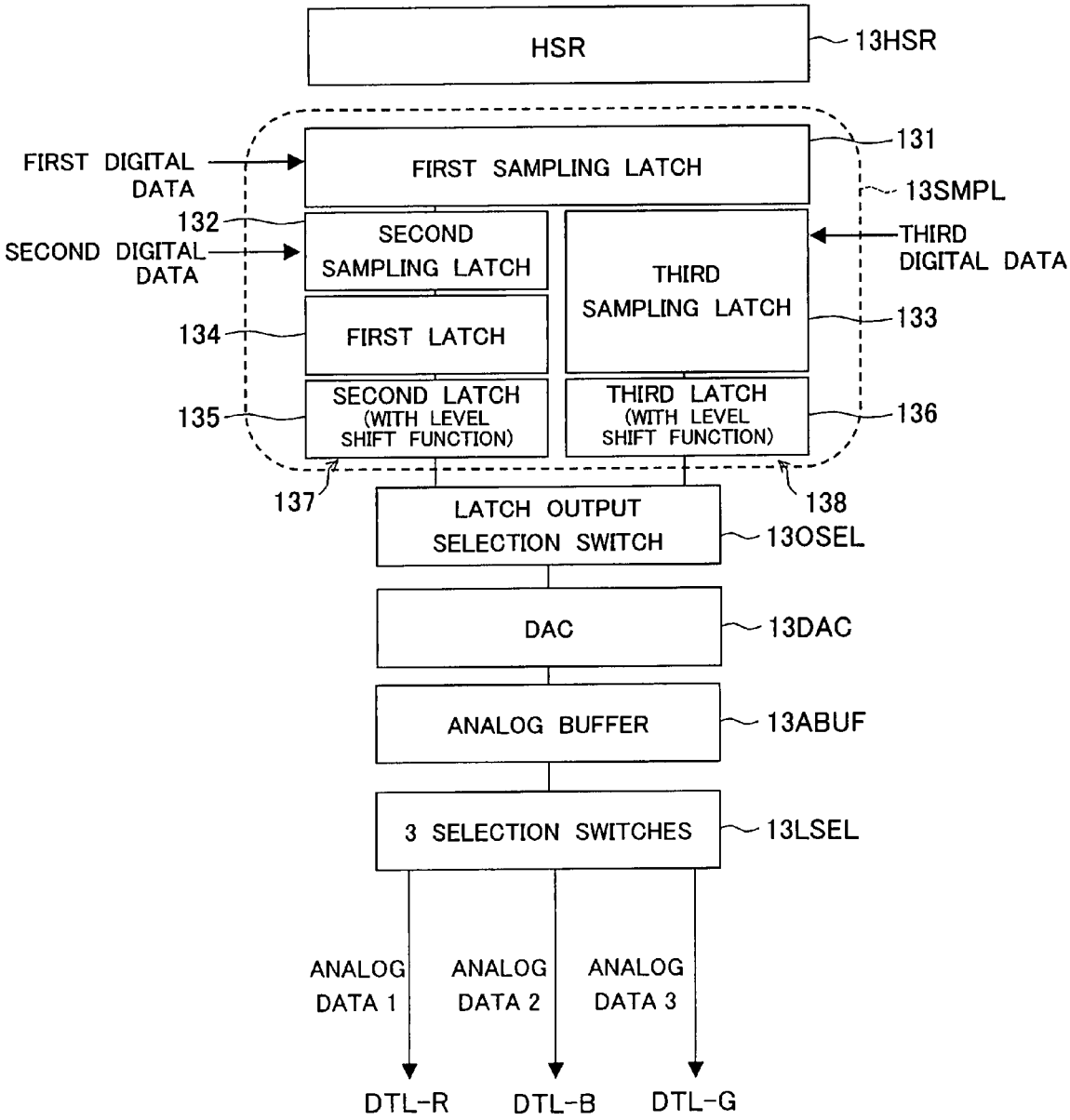
FIG. 6 is a block diagram showing an example of the basic configurations of first and second horizontal drive circuits of the present embodiment.

FIG. 6 is a block diagram showing an example of the basic configurations of the first horizontal drive circuit 13U and the second horizontal drive circuit 13D of the present embodiment. Below, they will be explained as the horizontal drive circuit 13.

Note that this horizontal drive circuit shows the basic configuration corresponding to three digital data, actually, a plurality of the same configurations is arranged in parallel.

The horizontal drive circuit 13, as shown in FIG. 6, has a shift register (HSR) group 13HSR, a sampling latch circuit group 13SMPL, a latch output selection switch 13OSEL, a digital/analog conversion circuit 13DAC, an analog buffer 13ABUF, and a line selector 13LSEL.

The shift register group 13HSR has a plurality of shift registers (HSR) for sequentially outputting shift pulses (sampling pulses) from each transfer stages corresponding to each column to the sampling latch circuit group 13SMPL in synchronization with horizontal transfer clocks HCK (not shown).

The sampling latch circuit group 13SMPL has a first sampling latch circuit 131 for sequentially sampling and latching the R data as the first digital data, a second sampling latch circuit 132 for sequentially sampling and latching the B data as the second digital data and latching the R data latched in the first sampling latch circuit 131 at a predetermined timing, a third sampling latch circuit 133 for sequentially sampling and latching the G data as the third digital data, a first latch circuit 134 for serially transferring the digital data R or B data latched in the second sampling latch circuit 132, a second latch circuit 135 having a level shift function for converting the digital R or B data latched in the first latch circuit 134 to a higher voltage amplitude and latching the same, and a third latch circuit 136 having a level shift function for converting the digital G data latched in the third sampling latch circuit 133 to a higher voltage amplitude and latching the same.

In the sampling latch circuit group 13SMPL having such the above configuration, a first latch system 137 is formed by the first sampling latch circuit 131, the second sampling latch circuit 132, the first latch circuit 134, and the second latch circuit 135, and a second latch system 138 is formed by the third sampling latch circuit 133 and the third latch circuit 136.

In the present embodiment, data input from the data processing circuit 15 to the horizontal drive circuits 13U and 13D are supplied at the level of the 0-3V (2.9V) system.

Then, by the level shift functions of the second and third latch circuits 135 and 136 which are of output stages of the sampling latch circuit group 13SMPL, that level is raised to for example −2.3V to 4.8V.

The latch output selection switch 13OSEL selectively switches the output of the sampling latch circuit group 13SMPL and outputs the same to the digital/analog circuit 13DAC.

The digital/analog conversion circuit 13DAC performs the digital/analog conversion three times during one horizontal period. Namely, the digital/analog conversion circuit 13DAC converts three digital R, B, and G data to the analog data during one horizontal period.

The analog buffer 13ABUF buffers the R, B, and G data converted to analog signals at the digital/analog conversion circuit 13DAC and outputs the same to the line selector 13LSEL.

The line selector 13LSEL selects three analog R, B, and G data during one horizontal period and outputs the same to corresponding data lines DTL-R, DTL-B, and DTL-G.

Here, an explanation will be given of the operation in the horizontal drive circuit 13.

In the horizontal drive circuit 13, when sampling continuous image data, they are stored in the first, second, and third sampling latch circuits 131, 132, and 133.

When completing the storage of all data in one horizontal direction line into the first, second, and third sampling latch circuits 131 to 133, the data in the second sampling latch circuit 132 is transferred to the first latch circuit 134 during a horizontal direction blanking period and immediately transferred to and stored in the second latch circuit 135.

Next, the data in the first sampling latch circuit 131 is transferred to the second sampling latch 132 and immediately transferred to and stored in the first latch circuit 134. Further, during the same period, the data in the third sampling latch circuit 133 is transferred to the third latch circuit 136.

Then, the data in the next horizontal direction line are stored in the first, second, and third sampling latch circuits 131, 132, and 133.

During the period where the data of the next horizontal direction line are stored, the data stored in the second latch circuit 135 and the third latch circuit 136 are output to the digital/analog conversion circuit 13DAC by switching of the latch output selection switch 13OSEL.

Thereafter, the data stored in the first latch circuit 134 is transferred to and stored in the second latch circuit 135. That data is output to the digital/analog conversion circuit 13DAC by switching of the latch output selection switch 13OSEL.

By this sampling latch method, three digital data are output to the digital/analog conversion circuit 13DAC, therefore it becomes possible to accomplish higher precision and narrower framing.

Further, the third digital data is to be a data having a color which is apt to exert the biggest influence upon the human eye, that is, G data, from the viewpoint that it is not accompanied by transfer work while storing data of one horizontal direction line, and it is good to write it in the sequence of B (Blue)→G (Green)→R (Red) in the case of the RGB selector drive on VT characteristics of the liquid crystal, and thus this shows a tolerance against variations in the image quality.

The data processing circuit 15 has a level shifter 151 for shifting levels of parallel digital R, G, and B data input from the outside from the 0-3V (2.9V) system to 6V system, a serial/parallel conversion circuit 152 for converting level shifted R, G, and B data from serial data to parallel data for phase adjustment and lowering the frequency, and a down converter 153 for down shifting the parallel data from the 6V system to 0-3V (2.9V) system and outputting the odd data to the horizontal drive circuit 13U and outputting the even data to the horizontal drive circuit 13D.

The power supply circuit 16 includes a DC-DC converter, is supplied with for example a liquid crystal voltage VDD1 (for example 2.9V) from the outside, boosts up this voltage to the internal panel voltage VDD2 (for example 5.8V) of the two times 6V system based on the corrected clocks obtained by correcting clocks having a low (slow) frequency and having variation in oscillation frequency by a predetermined correction system and the horizontal synchronization signal Hsync in synchronization with the master clock MCK and horizontal synchronization signal Hsync supplied from the interface circuit 17 or a built-in oscillation circuit, and supplies the same to circuits inside the panel.

Further, the power supply circuit 16 generates the negative voltages VSS2 (for example −1.9V) and VSS3 (for example −3.8V) as the internal panel voltages and supplies the same to the predetermined circuits (interface circuit etc.) inside the panel.

The interface circuit 17 shifts levels of the master clock MCK, horizontal synchronization signal Hsync, and vertical synchronization signal Vsync supplied from the outside up to the in-panel logic level (for example VDD2 level), supplies the master clock MCK, horizontal synchronization signal Hsync, and vertical synchronization signal Vsync after the level shift to the timing generator 18, and supplies the horizontal synchronization signal Hsync to the power supply circuit 16.

The interface circuit 17, in the case of a configuration performing the boost-up by the power supply circuit 16 based on corrected clocks obtained by correcting clocks of the built-in oscillation circuit without using the master clock, can be configured so as not to supply the master clock MCK to the power supply circuit 16. Alternatively, it is also possible to configure the interface circuit so that the master clock MCK is not used for boost-up on the power supply circuit 16 side while keeping the supply line of the master clock MCK from the interface circuit 17 to the power supply circuit 16 as it is.

In the present embodiment, the level shift system of the high frequency signal master clock MCK employs a level conversion circuit able to amplify the same input voltage as the power supply voltage of the IC by using low temperature polysilicon having high threshold value Vth and large variation.

Below, an explanation will be given of the concrete configuration and functions of the level conversion circuit in the interface circuit of the present embodiment.

Figure 7:
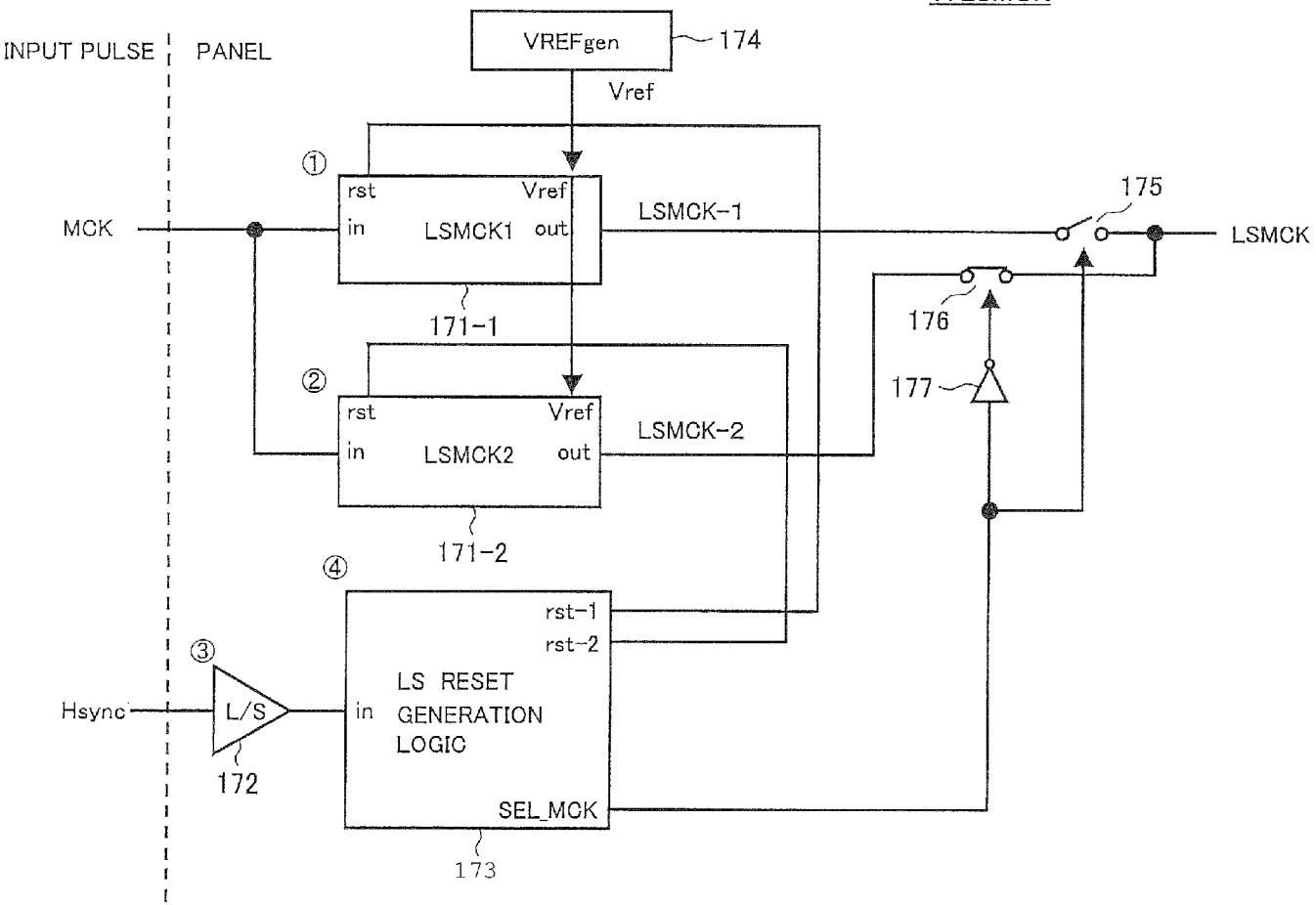
FIG. 7 is a view showing an example of the configuration of a level conversion circuit of a master clock in an interface circuit according to the present embodiment.

FIG. 7 is a view showing an example of the configuration of the level conversion circuit of the master clock in the interface circuit according to the present embodiment.

The level conversion circuit 17LSMCK of the master clock of the interface circuit 17, as shown in FIG. 7, has L (L=2 in the present embodiment) number of level shifters ($\overline{\text{L}}$SMCK1, LSMCK2) 171-1 and 171-2 connected in parallel with the input line of the master clock MCK of the RGB parallel interface and of a type where a reset operation is periodically necessary, an asynchronous type level shift circuit (L/S) 172 connected to the input line of the horizontal synchronization signal Hsync, a logic circuit 173 which uses the level shifted horizontal synchronization signal Hsync to input reset pulses for MCK level shifters 171-1 and 171-2 having a period of N horizontal periods to the level shifters 171-1 and 171-2 shifted in phase by M horizontal periods (note, M<N) and outputs the resultant signals, a reference voltage generation circuit 174 for supplying a reference voltage VRFEF to the level shifters 171-1 and 171-2, switch circuits 175 and 176 for realizing the function of selecting a circuit not performing a reset operation between outputs of the L number of MCK level shifters 171-1 and 171-2 for each M horizontal periods as the last output signal and outputting the level shift master clock LSMCK, and an inverter 177.

Figure 8:
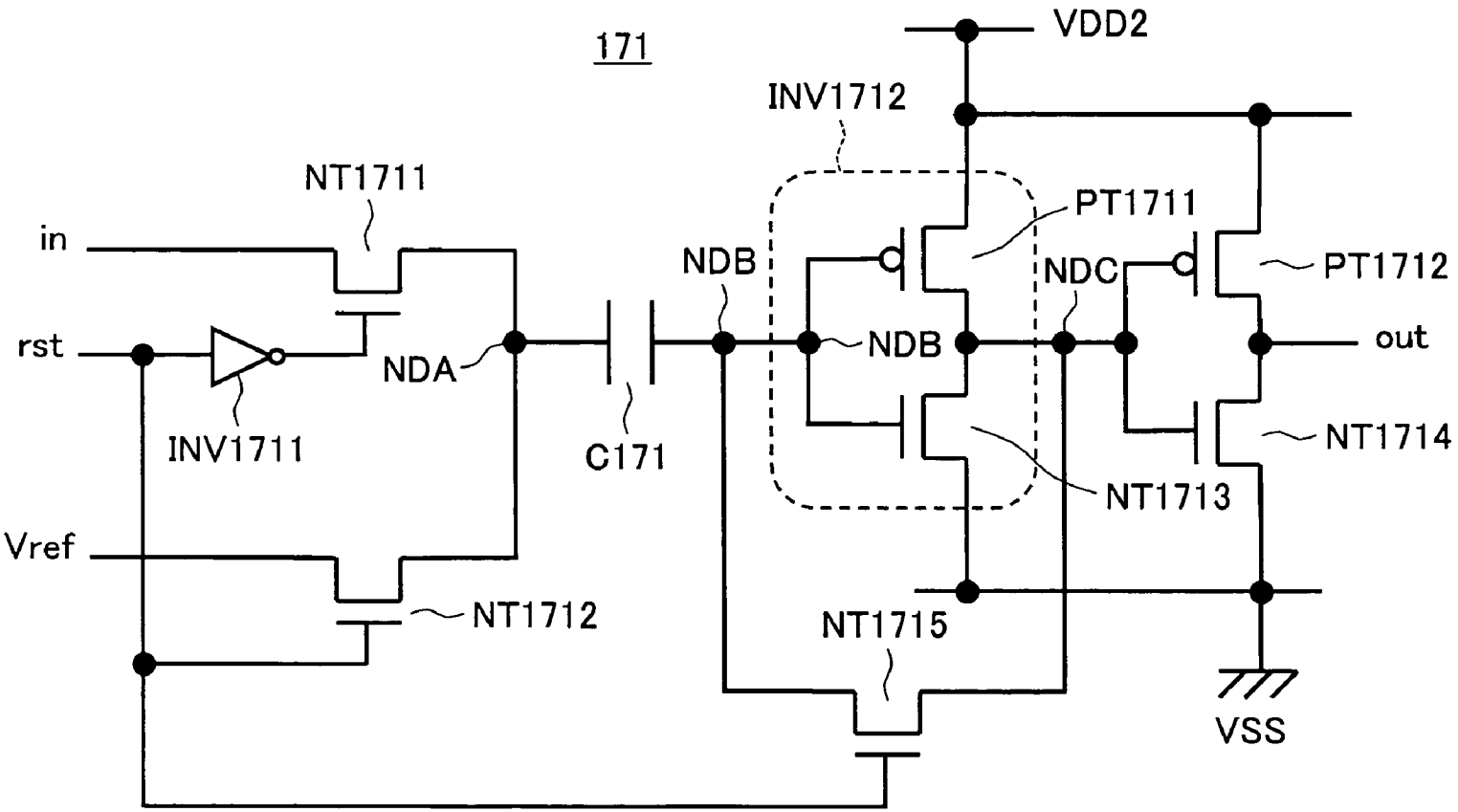
FIG. 8 is a circuit diagram showing a concrete example of the configuration of a level shifter in FIG. 7.

FIG. 8 is a circuit diagram showing an example of the concrete configuration of the level shifter 171 (-1,-2) of FIG. 7.

The level shifter 171 of FIG. 8 is configured as a so-called chopper type comparator type level shifter for shifting the level of the externally input MCK up to the in-panel logic voltage.

Specifically, the level shifter 171 has n-channel transistors NT1711 to NT1715, p-channel transistors PT1711 and PT1712, an inverter INV1711, and a capacitor C171. Further, in FIG. 8, an NDA indicates a first node, an NAB indicates a second node, and an NDC indicates a third node.

The transistor NT1711 is connected at its source and drain to an input terminal for the master clock MCK and the node NDA and connected at its gate to the output terminal of the inverter INV1711. The input terminal of the inverter INV1711 is connected to the input line of the reset signal rst.

The transistor NT1712 is connected at its source and drain to an input terminal Vref of the reference voltage VREF and the node NDA and connected at its gate to the input line of the reset signal rst.

The source of the transistor PT1711 is connected to the supply line of an in-panel drive voltage (second power supply voltage) VDD2, the drain is connected to the drain of the transistor NT1713, and the source of the transistor NT1713 is connected to the reference potential VSS (GND). Then, the gate of the transistor PT1711 and the gate of the transistor NT1713 are connected to each other to form the node NDB. These transistors PT1711 and NT1713 form the inverter INV1712.

The source of the transistor PT1712 is connected to the supply line of the in-panel drive voltage (second power supply voltage) VDD2, its drain is connected to the drain of the transistor NT1714, and the source of the transistor NT1714 is connected to the reference potential VSS (GND). A connection point of transistors PT1712 and NT1714 is connected to the output terminal Tout.

Then, the gate of the transistor PT1712 and the gate of the transistor NT1715 are connected to each other, and the connection point of these gates and the connection point of drains of the transistor PT1711 and the transistor NT1713 are connected to form the node NDC.

The transistor NT1715 (switching transistor) is connected at its source and drain to the node NDB and the node NDC and connected at its gate to the input line of the reset signal rst.

The first electrode of the capacitor C171 is connected to the node NDA, and the second electrode is connected to the node NDB.

The logic circuit 173 has a logic circuit for using the horizontal synchronization signal Hsync shifted in level by the asynchronous type level shifter circuit 172 able to asynchronously shift the level of an externally input Hsync up to the in-panel logic voltage (VDD2) so as to generate reset signals rst-1 and rst-2 of the MCK level shifters 171-1 and 171-2.

Figure 9:
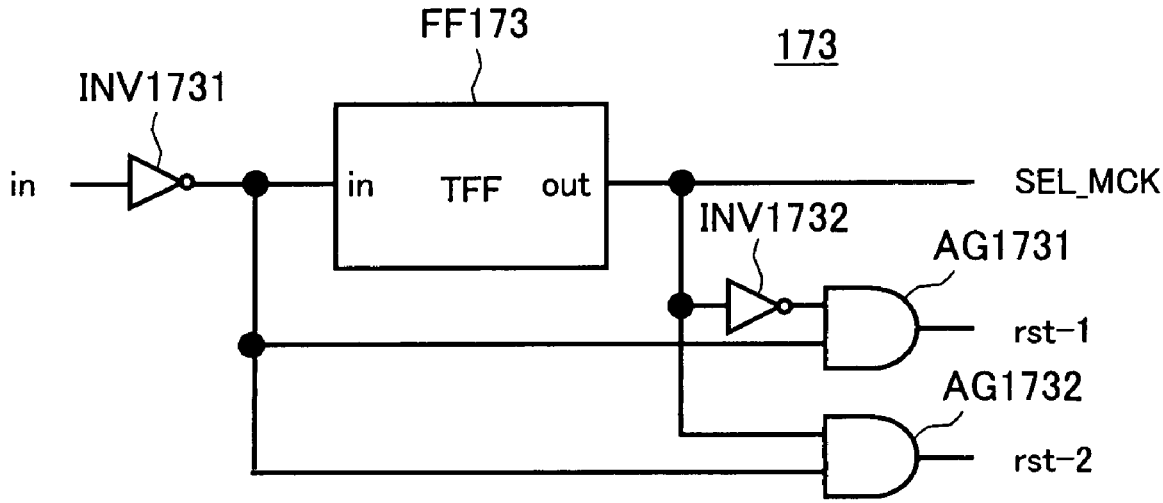
FIG. 9 is a circuit diagram showing a concrete example of the configuration of a logic circuit in FIG. 7.

FIG. 9 is a circuit diagram showing an example of the concrete configuration of the logic circuit 173 of FIG. 7.

The logic circuit 173, as shown in FIG. 9, has inverters INV1731 and INV1732, a T-type flip-flop FF173, and two-input AND gates AG1731 and AG1732.

The input terminal of the inverter INV1731 is connected to the input terminal Tin of the level shift horizontal synchronization signal Hsync, while the output terminal is connected to the input terminal Tin of the T-type flip-flop FF173, one input terminal of the AND gate AG1731, and one input terminal of the AND gate AG1732.

The other input terminal of the AND gate AG1731 is connected to the output terminal of the inverter INV1732. Then, the input terminal of the inverter INV1732 and the other input terminal of the AND gate AG1732 are connected to the output terminal out of the T-type flip-flop FF173. Further, a selection pulse SEL MCK for switching switches 175 and 176 is output from the output terminal out of the T-type flip-flop FF173.

The reference voltage generation circuit 174 generates the reference voltage VREF of VDD0/2 which is a half level of the voltage VDD0 (for example 1.8V), and supplies the same to reference voltage input terminals Vref of the level shifters 171-1 and 171-2.

Figure 10:
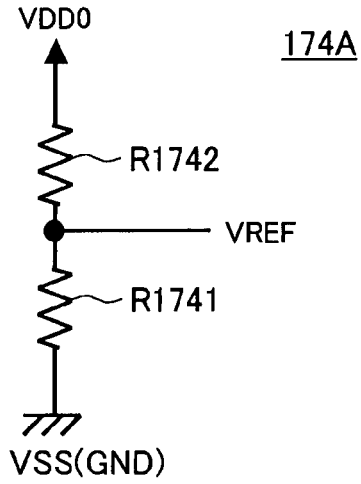
FIG. 10 is a circuit diagram showing an example of the configuration of a reference voltage generation circuit in FIG. 7.
Figure 11:
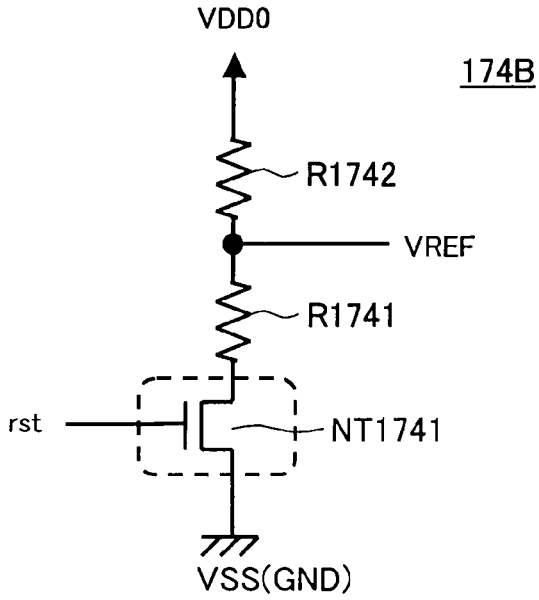
FIG. 11 is a circuit diagram showing another example of the configuration of the reference voltage generation circuit in FIG. 7.

FIG. 10 and FIG. 11 are circuit diagrams showing examples of the configuration of the reference voltage generation circuit 174 of FIG. 7.

A reference voltage generation circuit 174A of FIG. 10 is configured so that resistor elements R1741 and R1742 are connected in series between the supply line of the voltage VDD0 and the reference potential VSS (GND). The reference voltage VREF of VDD0/2 is output from a middle point of connection of the two resistor elements.

The reference voltage generation circuit 174B of FIG. 11 is configured with the drain and source of the n-channel transistor NT1741 having a gate connected to the supply line of the reset signal rst connected between one end of the resistor element T1741 on the ground side and the reference potential VSS in addition to the configuration of FIG. 10.

The reference voltage generation circuit 174B in FIG. 11 provides the transistor NT1741 as the switch for sending a current in the resistor element at only the time of the reset operation to realize a constant current and realize reduction of in-panel current consumption.

Here, the operation of the level conversion circuit 17LSMCK according to the present embodiment will be explained with reference to the timing charts of FIG. 12 and FIG. 13.

Figure 12:
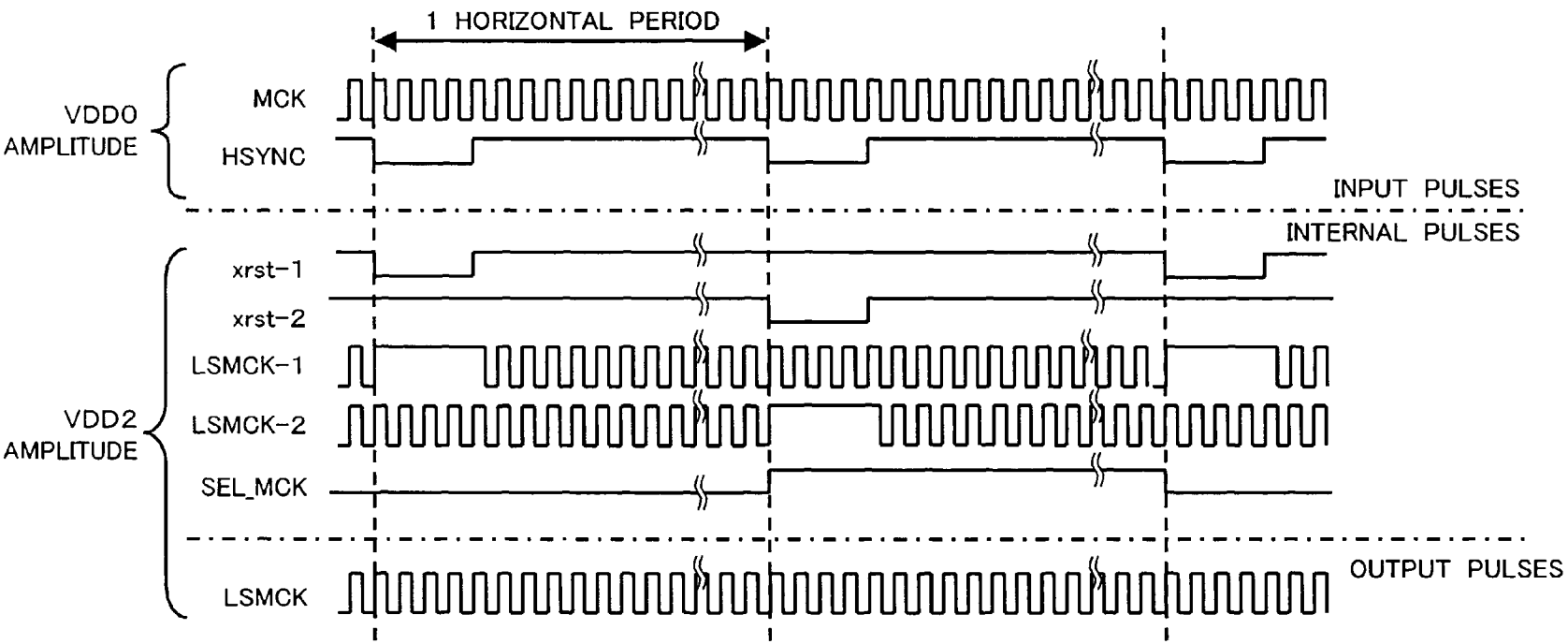
FIG. 12 is a view showing an overall timing chart of a level conversion circuit in FIG. 7.
Figure 13:
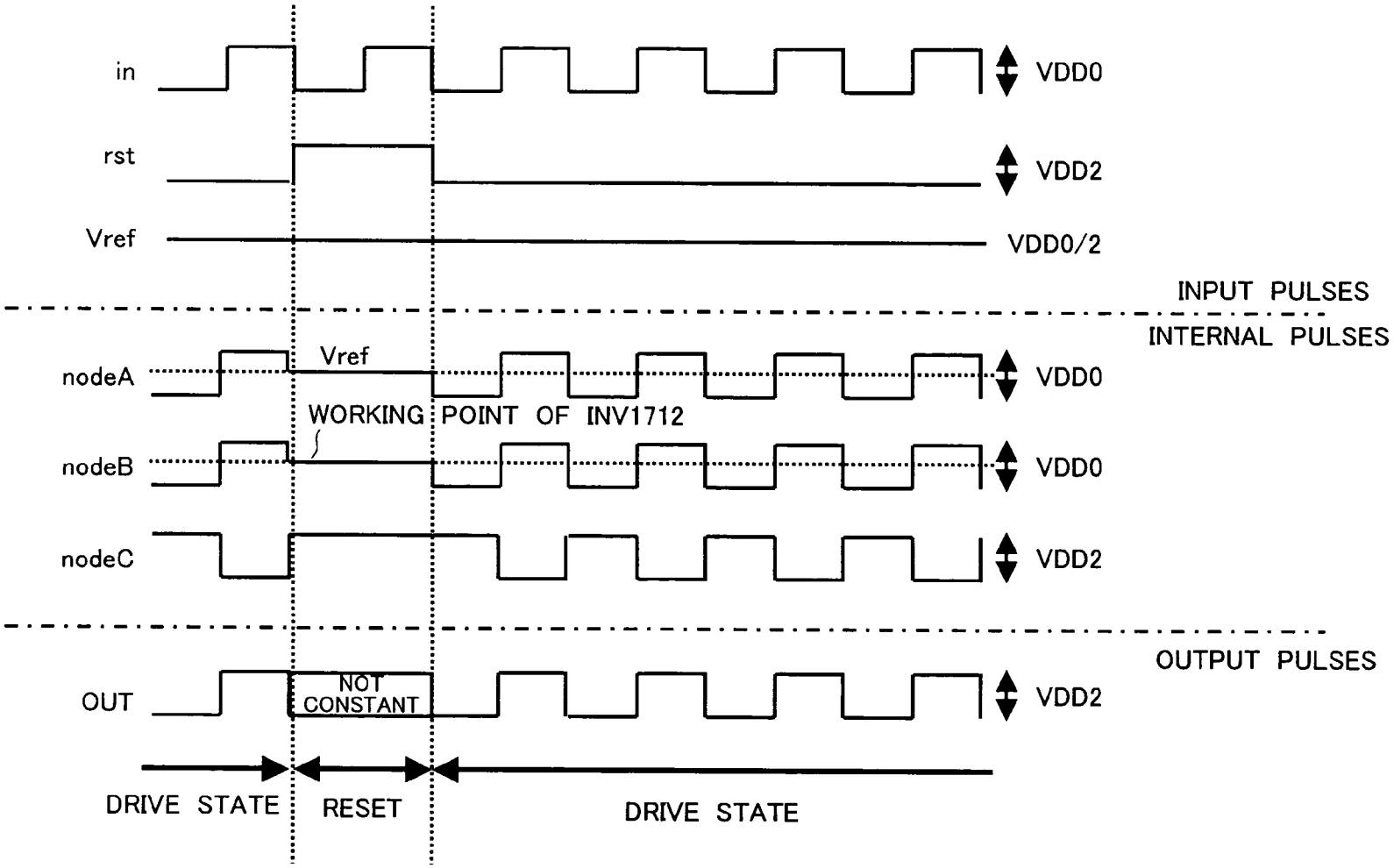
FIG. 13 is a view showing a timing chart of the level shifter in FIG. 8.

FIG. 12 shows the overall timing chart of the level conversion circuit in FIG. 7, and FIG. 13 shows a timing chart of the level shifter in FIG. 8.

As the RGB parallel interface signals, the master clock MCK and the horizontal synchronization signal Hsync are input.

The horizontal synchronization signal Hsync is converted in level from the input voltage level (VDD0 amplitude) to the in-panel logic voltage (VDD2 amplitude) at the level shifter 172. The level converted horizontal synchronization signal Hsync is input to the logic circuit 173.

The logic circuit 173 generates reset pulses rst-1 and rst-2 having periods of 2 horizontal periods and a selection pulse SEL_MCK of the last output switching use SW. Here, the output is performed at timings of the phases of the reset pulses rst-1 and rst-2 shifted by exactly 1 horizontal period.

The signals of the reset pulses rst-1 and rst-2 are input to the level shifters 171-1 and 171-2. The level shifters 171-1 and 171-2 are reset by this during the period of 2 horizontal periods.

The last output signal LSMCK is output as one signal selected from the output signals of the level shifters 171-1 and 171-2. At the output of the level shifters 171-1 and 171-2, the phase of the selection pulse SEL_MCK is determined so that the circuit not performing the reset operation is selected.

The operation inside the level shifters 171-1 and 171-2 will be explained in further detail with reference to FIG. 13.

During the reset period, the transistor NT1711 turns off, the transistors NT1712 and NT1715 turn on, and the CMOS inverter INV1712 of FIG. 8 is bypassed (the nodes NDB and NDC are short-circuited), therefore the potential at the node NDB and the node NDC become the working point voltage of the inverter INV1712.

On the other hand, the potential at the node NDA becomes the VREF (=VDD0/2) potential.

In the drive state, the transistor NT1711 turns on, the transistors NT1712 and NT1715 turn off, and the potential at the node NDA becomes the potential of the external input pulse MCK.

The node NDB is C-coupled by the capacitor C171 and amplifies the potential by the voltage of VDD0 around the working point of the inverter INV1712.

The potential of the inverter INV1712 is near the working point, therefore, even when the amplitude of the gate potential is very small, a current large enough to sufficiently drive the gate capacity of the latter stage flows. For this reason, the Tout output becomes a signal obtained by amplifying MCK from VDD0 to VDD2 potential.

The interface circuit 17 having such configuration has the following characteristics.

Figures 14A, 14B, 14C:
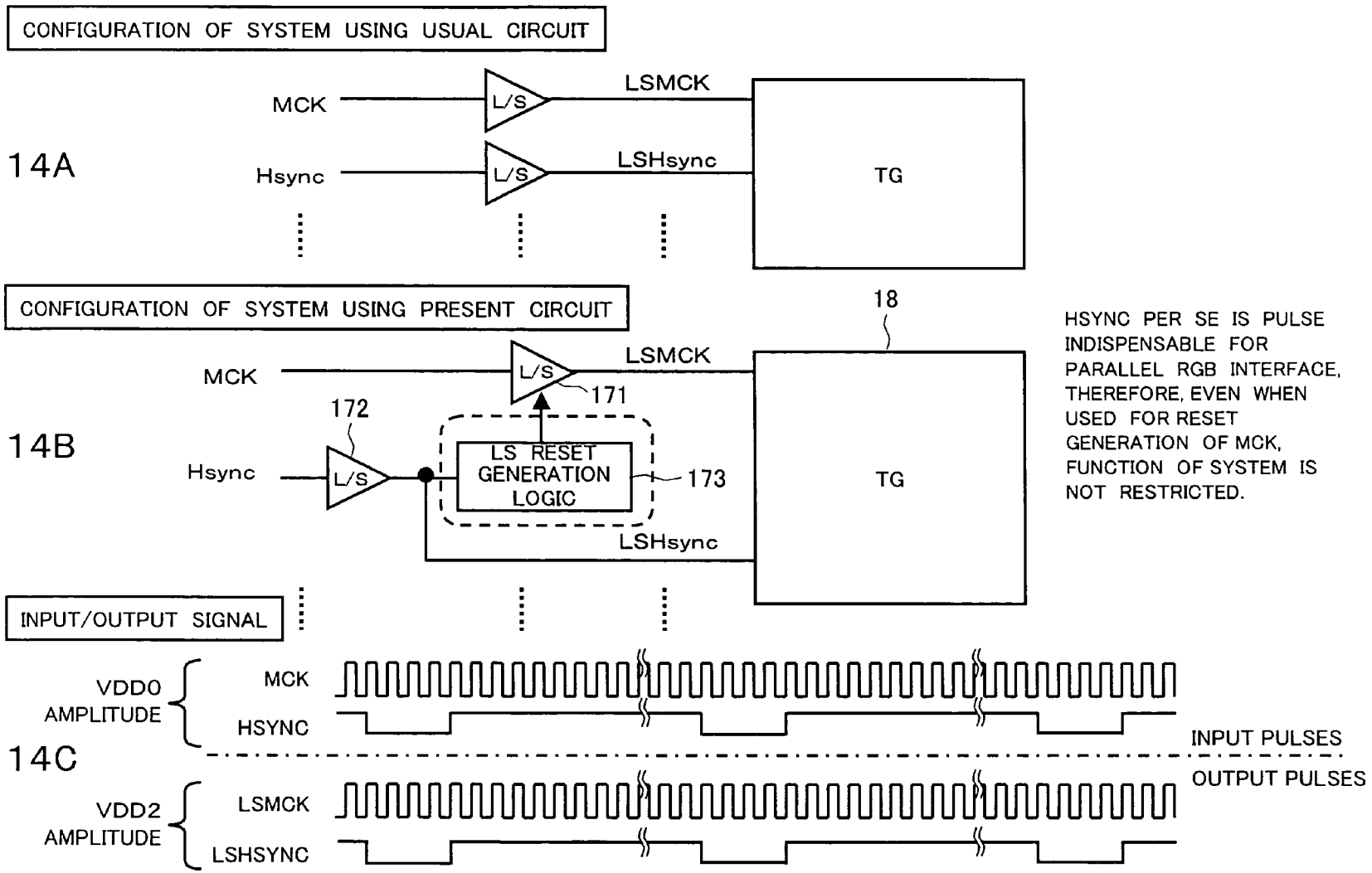
FIG. 14A to FIG. 14C are diagrams for explaining characteristics of an interface circuit according to the present embodiment.

In existing display devices, as shown in FIG. 14A, the asynchronous type level shifter L/S was connected to input pulses of the master clock MCK and horizontal synchronization signal Hsync, and the voltage was boosted up to the logic voltage in the panel, then output to the timing generator 18.

As opposed to this, according to the interface circuit 17 of the present embodiment, as shown in FIG. 14B and FIG. 14C, the level shifter 171 requiring the reset is connected to the master clock MCK, and that reset signal is generated by using the horizontal synchronization signal Hsync level converted at the asynchronous type level shifter 172. The horizontal synchronization signal Hsync is the pulse indispensable for the parallel RGB interface, therefore it is possible to obtain output waveforms of the same timing no matter which system is used. Further, even when the horizontal synchronization signal Hsync is used for the reset of the master clock MCK, the function of system is not restricted.

Note that the MCK use level shifter 171 is not limited to the configuration in FIG. 8. It is also possible to employ for example the circuit configurations in FIG. 15 and FIG. 16.

Figure 15:
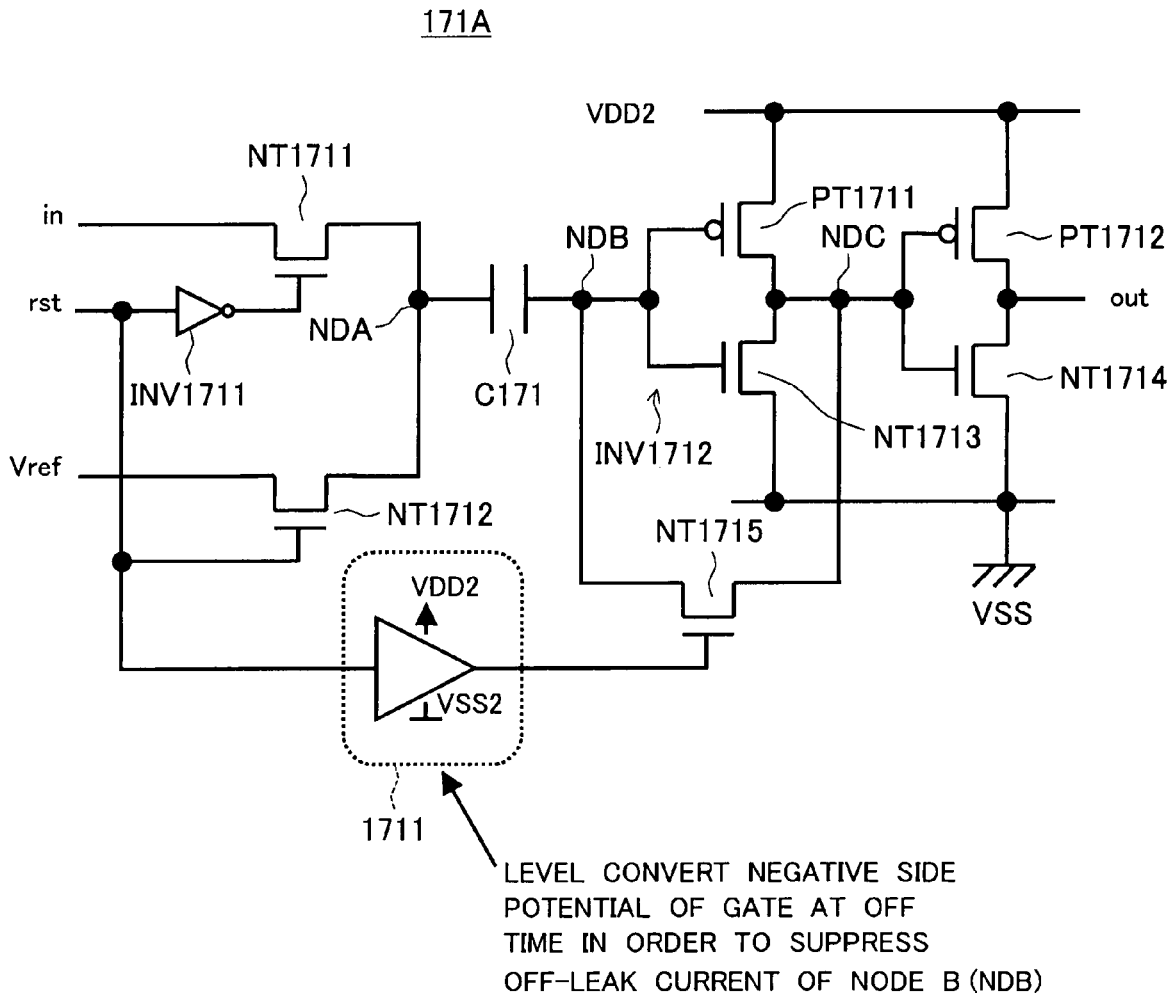
FIG. 15 is a circuit diagram showing another example of the configuration of an MCK level shifter according to the present embodiment.

The level shifter 171A of FIG. 15 provides a conversion portion 1711 for converting the level of the negative side of the voltage applied to the gate of the transistor NT1715 used as the switch for selectively connecting the node NDB and the node NDC, whereby it becomes possible to reduce an off-leak current of the node NDB in the drive state. The change of the stored potential by the off-leak of the node NDB remarkably degrades the operation of this circuit, therefore the reduction of the off-leak current is very important.

Figure 16:
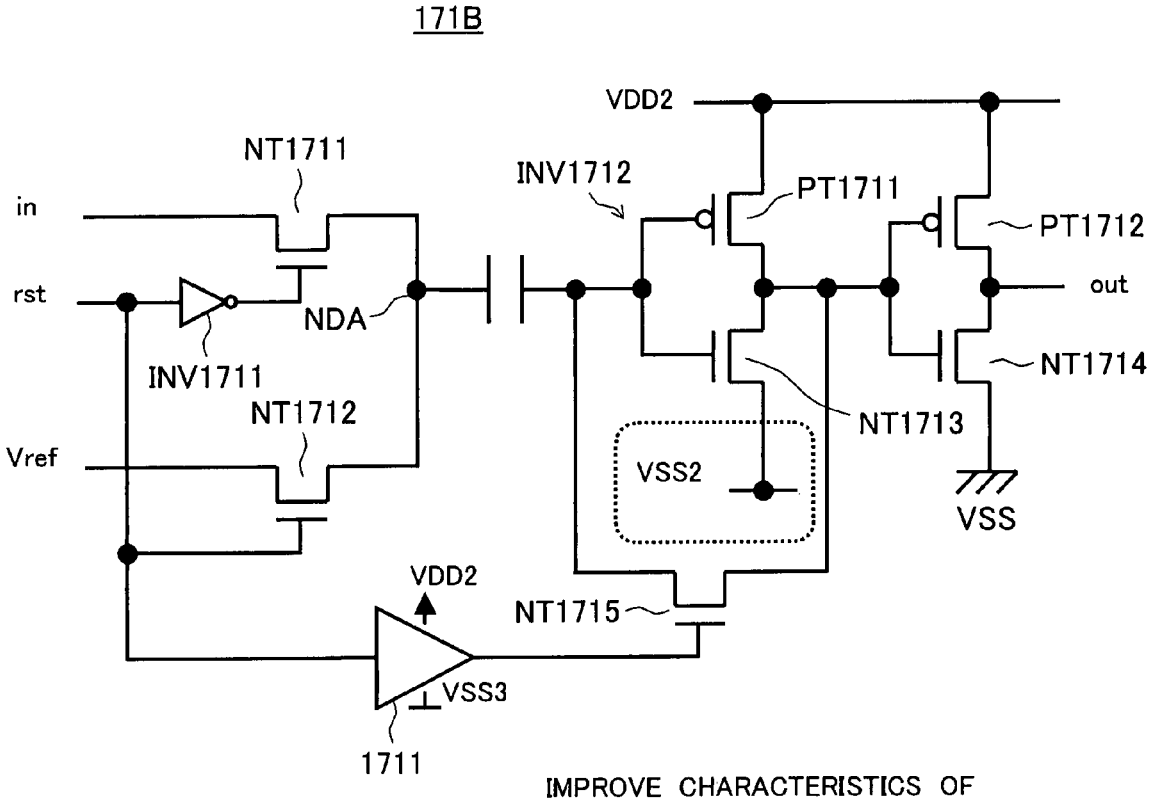
FIG. 16 is a circuit diagram showing a further example of the configuration of the MCK level shifter according to the present embodiment.

The difference of the level shifter 171B in FIG. 16 from the circuit configuration of FIG. 15 resides in that the potential level VSS2 of the negative side of the inverter INV1712 is lowered.

By this change, the characteristics of the inverter INV1712 are improved, therefore the dynamic range of the level shifter increases.

The timing generator 18, in synchronization with the master clock MCK, horizontal synchronization signal Hsync, and vertical synchronization signal Vsync supplied from the interface circuit 17, generates a horizontal start pulse HST and horizontal clock pulse HCK (HCKX) used as clocks of the horizontal drive circuits 13U and 13D and a vertical start pulse VST and vertical clock VCK (VCKX) used as clocks of the vertical drive circuit 14, supplies the horizontal start pulse HST and horizontal clock pulse HCK (HCKX) to the horizontal drive circuits 13U and 13D, and supplies the vertical start pulse VST and vertical clock VCK (VCKX) to the vertical drive circuit 14.

Next, the operation according to the above configuration will be explained.

The master clock MCK and the horizontal synchronization signal Hsync are input to the interface circuit 17 as the RGB parallel interface signals.

In the interface circuit 17, the horizontal synchronization signal Hsync is converted in level from the input voltage level (VDD0 amplitude) to the in-panel logic voltage (VDD2 amplitude) by the level shifter 172. The level converted horizontal synchronization signal Hsync is input to the logic circuit 173.

The logic circuit 173 generates reset pulses rst-1 and rst-2 having a duration of 2 horizontal periods and the selection pulse SEL_MCK of the last output switching use SW. Here, the reset pulses rst-1 and rst-2 are output at a timing shifted in phase by exactly 1 horizontal period.

Signals of the reset pulses rst-1 and rst-2 are input to the level shifters 171-1 and 171-2. Due to this, the level shifters 171-1 and 171-2 are reset during a period of 2 horizontal periods.

Then, the last output signal LSMCK is output as one signal selected from the output signals of the level shifters 171-1 and 171-2.

The parallel digital data input from the outside are subjected to phase adjustment and parallel conversion for lowering the frequency at the data processing circuit 15 on the glass substrate 11, and the R data, B data, and G data are output to the first and second horizontal drive circuits 13U and 13D.

In the first and second horizontal drive circuits 13U and 13D, the digital G data input from the data processing circuit 15 are sequentially sampled for 1H and held by the third sampling latch circuit 133. Thereafter, they are transferred to the third latch circuit 136 for the horizontal blanking period.

Parallel to this, the R data and B data are separately sampled for 1H, held in the first and second sampling latch circuits 131 and 132, and transferred to the first latch circuit 134 in the next horizontal blanking period.

When the storage of all data of one horizontal direction line into the first, second, and third sampling latch circuits 131 to 133 is completed, the data in the second sampling latch circuit 132 is transferred to the first latch circuit 134 during the horizontal direction blanking period and immediately transferred to and stored in the second latch circuit 135.

Next, the data in the first sampling latch circuit 131 is transferred to the second sampling latch 132 and immediately transferred to and stored in the first latch circuit 134. Further, during the same period, the data in the third sampling latch circuit 133 is transferred to the third latch circuit 136.

Then, the data of the next horizontal direction line are stored in the first, second, and third sampling latch circuits 131, 132, and 133.

During the period where the data of the next horizontal direction line are stored, the data stored in the second latch circuit 135 and the third latch circuit 136 are output to the digital/analog conversion circuit 13DAC by switching of the latch output selection switch 13OSEL.

Thereafter, the data stored in the first latch circuit 134 is transferred to and stored in the second latch circuit 135. That data is output to the digital/analog conversion circuit 13DAC by switching of the latch output selection switch 13OSEL.

The R, B, and G data converted to analog data at the digital/analog conversion circuit 13DAC are held in the analog buffer 13ABUF during the next 1H period, and the analog R, B, and G data are selectively output to the corresponding data line in a form with 1H period divided into three.

Note that this can be realized even when the sequence of processing of G, R, and B is switched.

As explained above, according to the present embodiment, the level conversion circuit 17LSMCK of the master clock of the interface circuit 17 has the L (L=2 in the present embodiment) number of level shifters 171-1 and 171-2 connected in parallel with the input line of the master clock MCK of the RGB parallel interface and of a type where a reset operation is periodically necessary, the asynchronous type level shift circuit 172 connected with the input line of the horizontal synchronization signal Hsync, the logic circuit 173 which uses the level shifted horizontal synchronization signal Hsync to input reset pulses for MCK level shifters 171-1 and 171-2 having a period of N horizontal periods to the level shifters 171-1 and 171-2 shifted in phase by M horizontal periods (note, M<N) and outputs the resultant signals, the reference voltage generation circuit 174 for supplying a reference voltage VREF to the level shifters 171-1 and 171-2, the switch circuits 175 and 176 for realizing the function of selecting a circuit not performing a reset operation between outputs of the L number of MCK level shifters 171-1 and 171-2 for each M horizontal periods as the last output signal and outputting the level shift master clock LSMCK, and the inverter 177, therefore the following effects can be obtained.

Namely, the parallel RGB input signals output from the set side can be directly received, therefore it becomes possible to eliminate the cost of the externally installed ICs.

Since the number of externally installed parts can be decreased, improvement of reliability can be achieved.

Further, since the externally installed parts become unnecessary, it becomes possible to contribute to the reduced thickness of the module.

Further, according to the present embodiment, there is to provide a first latch system 137 cascade connecting the sampling latch circuits 131 and 132, the first latch circuit 134, and the second latch circuit 135 for the first digital data (R) and the second digital data (B) and serially transferring data and a second latch system 138 cascade connecting the sampling latch circuit 133 and the third latch circuit 136 for the third digital data, and provision is made of a common digital/analog (DA) conversion circuit 13DAC, analog buffer circuit 13ABUF, and the line selector 13LSEL selectively outputting three analog data (R, B, G) to the corresponding data line in one horizontal period (H), as a result, the following effects can be obtained.

By employing this configuration, the number of DA conversion circuits and analog buffer circuits which become necessary in the width of the same dot pitch as that of the already existing system is decreased, and it becomes possible to realize narrower framing.

Further, by configuring the data processing circuit by the first and second digital data use and third digital data use sampling latch circuits, it becomes possible to realize a higher precision.

Namely, according to the present system, a higher precision and narrower framed three-line selector system and integral drive circuit type display device using this can be realized on the insulating substrate.

Further, the number of horizontal drive circuits can be reduced, therefore a low power consuming three-line selector system and integral drive circuit type display device using this can be realized.

Further, the data is divided into three and output in one horizontal period, therefore the operation becomes high speed, but a three-line selector system having a tolerance against variations in image quality and an integral drive circuit type display device using this can be realized.

Note that, in the embodiment described above, the explanation was given by taking as an example the case where the present invention was applied to an active matrix type liquid crystal display device, but the present invention is not limited to that and can also be applied to other active matrix type display devices such as EL display devices using the electroluminescence (EL) elements as electro-optical elements of the pixels in the same way.

Furthermore, the active matrix type display device represented by the active matrix type liquid crystal display device according to the present embodiment described above may be used as the display of a personal computer, word processor, or other OA apparatus or television receiver etc. and also is suitable for use as the display portion of a mobile phone, PDA, or other mobile terminal now being made smaller and more compact in size.

Figure 17:
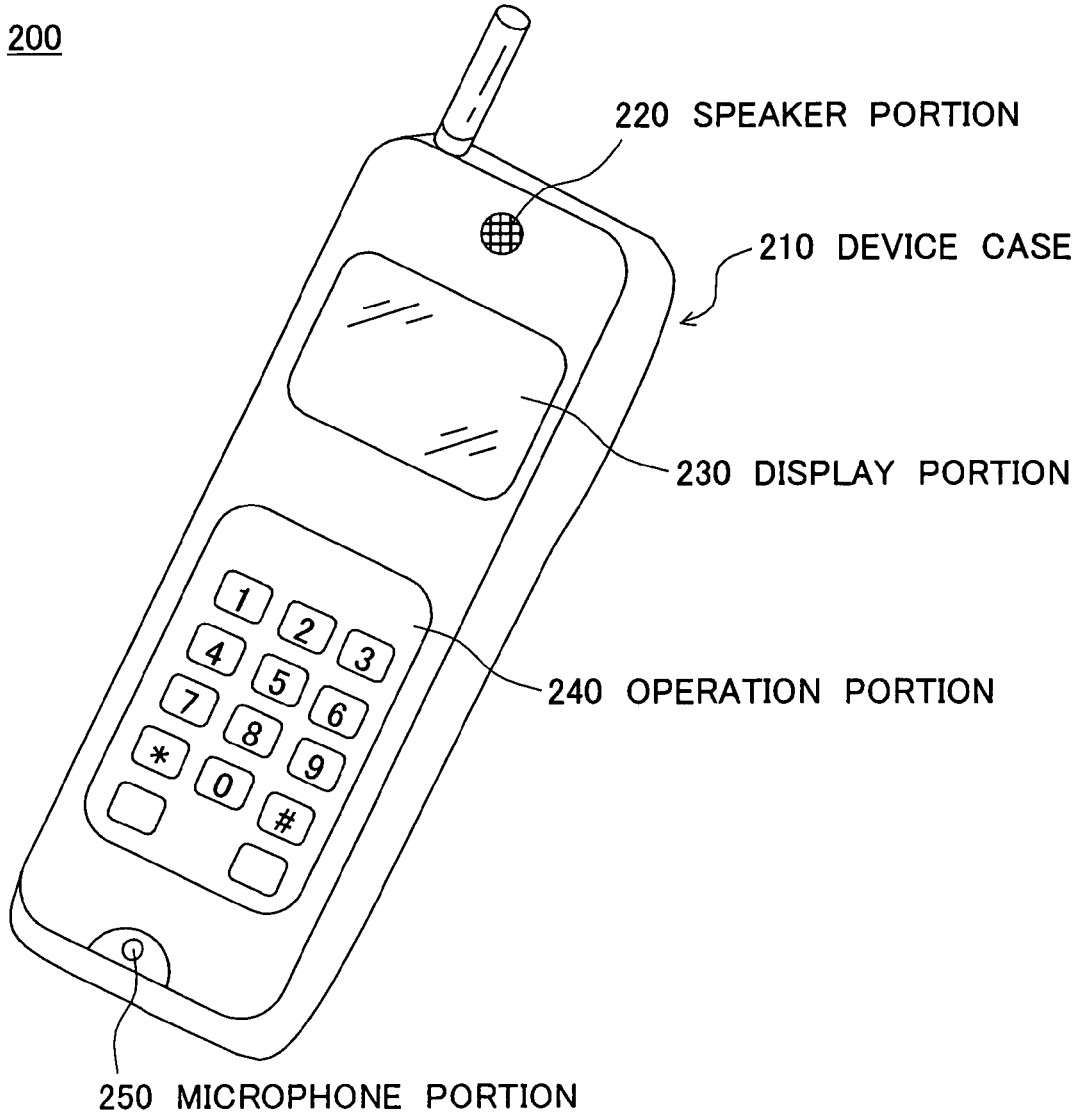
FIG. 17 is a view of the outer appearance schematically showing the configuration of a mobile terminal according to the embodiment of the present invention comprised of a mobile phone.

FIG. 17 is a view of appearance showing the schematic configuration of a mobile terminal to which the present invention is applied, for example, a mobile phone.

A mobile phone 200 according to the present example is configured with, on the front surface of a device case 210, a speaker portion 220, a display portion 230, an operation portion 240, and a microphone portion 250 sequentially arranged from the upper portion side.

In the mobile phone having such a configuration, as the display portion 230, for example, a liquid crystal display device is used. As this liquid crystal display device, the active matrix type liquid crystal display device according to the above explained embodiment is used.

In this way, in a mobile phone or other mobile terminal, by using an active matrix type liquid crystal display device according to the previously explained embodiment as the display portion 230, it becomes possible to eliminate the costs of the externally installed ICs in the circuits mounted on this liquid crystal display device, it is possible to decrease the number of externally installed parts, and, since the externally installed parts become unnecessary, it becomes possible to contribute to the reduced thickness of the module.

Further, the narrowing of pitch is possible, the narrowing of frame can be realized, and lowering of power consumption of the display device can be achieved, so a reduction of power consumption of the terminal becomes possible.

INDUSTRIAL APPLICABILITY

The display device and electronic apparatus of the present invention can amplify the same input voltage as the power supply voltage of an IC by using low temperature polysilicon having a high threshold voltage and large variation, therefore they can be used for the display of a personal computer, word processor, or other OA apparatus or television receiver etc. and also may be used for the display portion of a mobile phone or other mobile terminal or PDA etc. now being made smaller and more compact in size.

The invention claimed is:

1. An integral drive circuit type display device supplied with at least a master clock, comprising a level conversion circuit for converting a first level at a time of input of said master clock to a second level of an internal drive voltage level and outputting a level shifted master clock to a predetermined circuit, wherein said level conversion circuit includes L number of level shifters configured to perform a reset operation periodically, a logic circuit for inputting reset pulses to said level shifters having a period of N horizontal periods shifted by M horizontal periods (where M<N) based on a level shifted horizontal synchronization signal Hsync, and selecting a circuit not performing the reset operation among the outputs of the L number of level shifters for the M horizontal periods to output the level shifted master clock.

2. A display device as set forth in claim 1, wherein said level shifter comprises an inverter connected between said internal drive voltage level potential and a reference potential, a first node, a second node connected to an input of said inverter, a third node connected to an output of said inverter, a capacitor connected between said first node and said second node, and a circuit for preventing the input of said master clock for exactly a reset period, supplying an intermediate potential of said first level potential and reference potential to said first node, and bringing said second node and said third node into conductive states.

3. A display device as set forth in claim 2, wherein said second node and said third node are connected by a switching transistor, and a gate potential of the switching transistor is held at a negative potential when not conductive.

4. A display device as set forth in claim 2, wherein said inverter is connected to the negative potential in place of the reference potential.

5. An electronic apparatus having an integral drive circuit type display device supplied with at least a master clock, wherein said display device comprises a level conversion circuit for converting a first level at a time of input of said master clock to a second level of an internal drive voltage level and outputting a level shifted master clock to a predetermined circuit, and wherein said level conversion circuit includes L number of level shifters configured to perform a reset operation periodically, a logic circuit for inputting reset pulses to said level shifters having a period of N horizontal periods shifted by M horizontal periods (where M<N) based on a level shifted horizontal synchronization signal Hsync, and selecting a circuit not performing the reset operation among the outputs of the L number of level shifters for the M horizontal periods to output the level shifted master clock.

6. An electronic apparatus as set forth in claim 5, wherein said level shifter comprises an inverter connected between said internal drive voltage level potential and a reference potential, a first node, a second node connected to an input of said inverter, a third node connected to an output of said inverter, a capacitor connected between said first node and said second node, and a circuit for preventing the input of said master clock for exactly a reset period, supplying an intermediate potential of said first level potential and reference potential to said first node, and bringing said second node and said third node into conductive states.

7. An electronic apparatus as set forth in claim 6, wherein said second node and said third node are connected by a switching transistor, and a gate potential of the switching transistor is held at a negative potential when not conductive.

8. An electronic apparatus as set forth in claim 6, wherein said inverter is connected to the negative potential in place of the reference potential.

* * * * *

UNITED STATES PATENT AND TRADEMARK OFFICE

CERTIFICATE OF CORRECTION

PATENT NO. : 8,339,387 B2
APPLICATION NO. : 11/886658
DATED : December 25, 2012
INVENTOR(S) : Masaki Murase et al.

It is certified that error appears in the above-identified patent and that said Letters Patent is hereby corrected as shown below:

Title Page: Item 57 Line 1 of the Abstract:

"the same input as" should read -- the same input voltage as --.

Signed and Sealed this
Seventh Day of May, 2013

Teresa Stanek Rea
*Acting Director of the United States Patent and Trademark Office*